US005836509A

United States Patent [19]

Van Loo

[11] Patent Number: 5,836,509

[45] Date of Patent: Nov. 17, 1998

[54] STORAGE AND DISPLAY BOX

[75] Inventor: Bruno Van Loo, Hillegom, Netherlands

[73] Assignee: Simple Pleasures Flowerbulbs & Perennials, Inc., Babylon, N.Y.

[21] Appl. No.: 940,483

[22] Filed: Sep. 30, 1997

[51] Int. Cl.[6] ..... B65D 5/00

[52] U.S. Cl. ..... 229/112; 229/194; 229/195

[58] Field of Search ..... 229/112, 113, 229/114, 193, 194, 195

[56] References Cited

U.S. PATENT DOCUMENTS

| | | | |
|---|---|---|---|
| 726,380 | 4/1903 | Ullathorne | 229/112 X |
| 1,071,563 | 8/1913 | Miller | 229/114 X |
| 1,101,479 | 6/1914 | Van Osdel . | |
| 1,357,519 | 11/1920 | Russell . | |
| 1,423,001 | 7/1922 | Maxwell | 229/112 X |
| 1,498,673 | 6/1924 | Reynolds . | |
| 1,844,066 | 2/1932 | Hughes . | |
| 1,955,663 | 4/1934 | Wendell | 229/114 X |
| 2,411,015 | 5/1946 | Wolff et al. | 229/112 X |
| 2,812,852 | 11/1957 | Samuels . | |
| 2,963,211 | 12/1960 | Agler . | |
| 3,002,672 | 10/1961 | Kotowick . | |
| 3,037,680 | 6/1962 | Hickin . | |
| 3,077,294 | 2/1963 | Barrez | 229/112 X |
| 3,347,394 | 10/1967 | Gould . | |
| 4,101,048 | 7/1978 | Rieben et al. . | |
| 5,462,220 | 10/1995 | Bacchetti et al. | 229/112 |

*Primary Examiner*—Gary E. Elkins
*Assistant Examiner*—Tri M. Mai
*Attorney, Agent, or Firm*—Collard & Roe, P.C.

[57] ABSTRACT

A storage box formed from a single folded sheet, comprising a bottom panel, and two side panels. Each side panel is integrally formed with a side edge of the bottom panel and has a sloped front edge and a straight back edge so that the free end of each side panel is narrower than the side edge of the bottom panel. A front panel is integrally formed with the front edge of the bottom panel and has a free end that is wider than said front edge of said bottom panel. A rear panel is integrally formed with the rear edge of the bottom panel and has a free end that is wider than the rear edge of said bottom panel. A plurality of flaps are integrally formed with the front and back edges of each of the side panels. A slit is arranged along the front and back edges of one of the side panels, and an insertion flap is attached to one of the front and back edges of the other side panel. The box can be assembled by folding the front panel, rear panel, and side panels perpendicular to the bottom panel, folding the flaps on the side panel having the slits over the front and rear panels, folding the flaps on the other side panel over the flaps on the side panel having the slits, and inserting the insertion flaps into the slits to secure the box in an assembled state. When assembled, the box is narrower at the bottom than at the top and the front of the box is angled rearward from vertical.

9 Claims, 2 Drawing Sheets

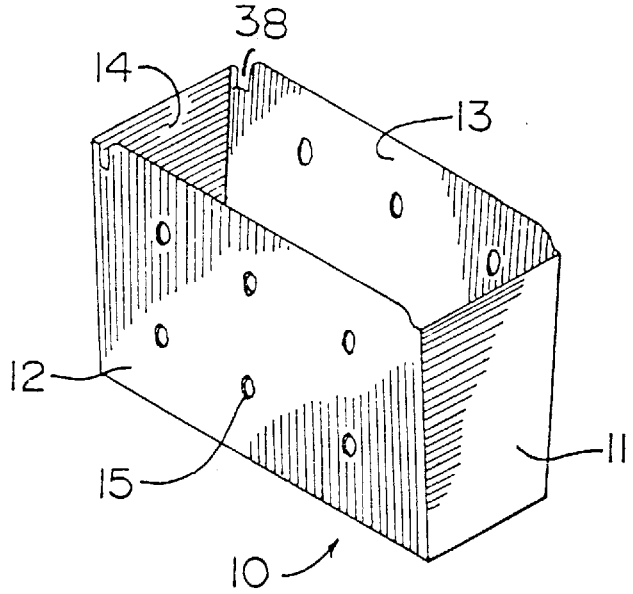
FIG. 1
FIG. 2
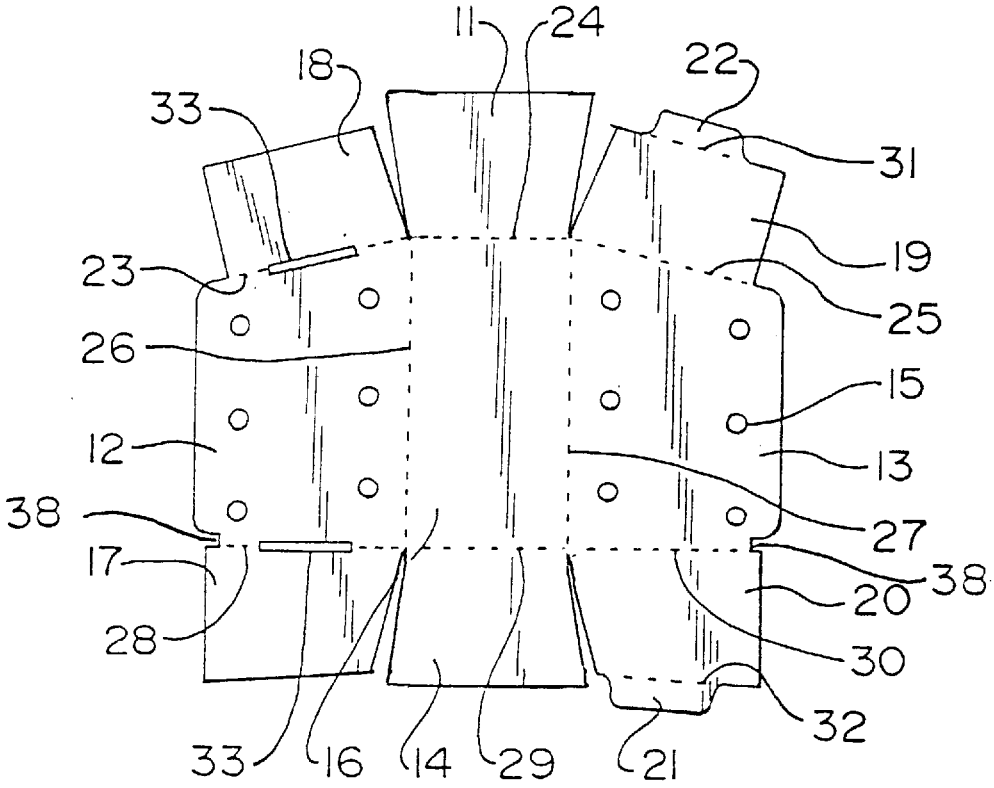

STORAGE AND DISPLAY BOX

BACKGROUND OF THE INVENTION

1. Field of the Invention

This invention relates to a storage box for use with a free-standing display rack. In particular, this invention relates to a storage box formed from a single sheet of material and which is especially adapted for storing and displaying flower bulbs.

2. The Prior Art

Boxes for storing and displaying organic material such as produce are well known. These boxes are usually constructed to be stackable and have ventilation holes to keep the stored produce fresh. One feature that has been found to be particularly useful in this field is to form the box from a single sheet of cardboard. This way, the box can be easily and inexpensively manufactured and assembled.

An example of such a box is shown in U.S. Pat. No. 4,101,048 to Rieben et al. This patent shows a produce box formed from a single folded blank. The box is equipped with holes along its sides to allow for ventilation of the contents. The box also has two walls that are higher than the others, so that when several boxes are stacked on top of one another, air can flow into the boxes through the space created by the shorter walls.

U.S. Pat. No. 1,101,479 to Van Osdel shows a berry box that permits stacking of the boxes on top of one another without crushing the berries contained therein. The box is formed from a single folded sheet and has ventilating openings to ventilate the berries.

Various other storage boxes that are formed from single folded sheets are shown in U.S. Pat. No. 2,963,211 to Agler, U.S. Pat. No. 3,002,674 to Kotowick, U.S. Pat. No. 1,357,519 to Russell and U.S. Pat. No. 1,844,066 to Hughes.

While all of the above boxes are adequate for basic storage purposes, they are not particularly well adapted for storing flower bulbs and for displaying such bulbs on a display rack. Because flower bulbs are living, it is necessary to provide the bulbs with adequate ventilation on all sides during storage and display. In addition, it is necessary to construct a box that will display the bulbs at an optimum angle while the box is hung on a display rack.

SUMMARY OF THE INVENTION

It is therefore an object of the present invention to provide a storage box for storing and displaying flower bulbs that is formed from a single folded sheet.

It is another object of the present invention to provide a storage box for storing and displaying flower bulbs that is shaped to adequately ventilate the bulbs during storage and display.

It is yet another object of the present invention to provide a storage box for storing and displaying flower bulbs that is adapted to be hung from a vertical display rack.

It is a further object of the present invention to provide a storage box for storing and displaying flower bulbs that is shaped to optimally display the bulbs while hanging from a vertical display rack.

These and other objects of the invention are accomplished by a storage box formed from a single folded sheet, comprising a bottom panel, and two side panels. Each side panel is integrally formed with a side edge of the bottom panel and has a sloped front edge and a straight back edge so that the free end of each side panel is narrower than the side edge of the bottom panel.

A front panel is integrally formed with the front edge of the bottom panel and has a free end that is wider than the front edge of the bottom panel. A rear panel is integrally formed with the rear edge of the bottom panel and has a free end that is wider than the rear edge of the bottom panel. A plurality of flaps are integrally formed with the front and back edges of each of the side panels. A slit is arranged along the front and back edges of one of the side panels, and an insertion flap is attached to the front and back edges of the flaps on the other side panel.

A notch is made in each side panel near the rear panel, to enable the box to be mounted on a display rack having horizontal beams and horizontal support bars. The notches can be fit around a horizontal beam on the rack and the bottom of the box can rest on the support bars to support the weight of the box.

The box can be assembled by folding the front panel, rear panel and side panels perpendicular to the bottom panel, folding the flaps on the side panel with the slits over the front and rear panels, folding the flaps on the other side panel over the flaps side panel with the slits, and inserting the insertion flaps into the slits to secure the box in an assembled state. When assembled, the box is narrower at the bottom than at the top and the front of the box is angled rearward from vertical.

The box according to the invention preferably has a plurality of ventilation holes arranged on each of the side panels, to allow for the flow of air into and out of the box. The feature is especially important if the box is being used to store live organic products, such as flower bulbs.

Because the box is formed from a single folded sheet of material and no adhesive is used to keep the box assembled, the box can be pre-printed on one surface and be plain on the other. The box is preferably formed from cardboard or corrugated paperboard. This way, the box can be used to display one type of product, about which illustrations or advertising material are printed on the outside of the box, and then after the product is sold or discarded, the box can be unfolded and reassembled so that the plain side is facing outward. In this way, the box can then be used for other types of products as well.

Alternatively, the box can be pre-printed on both sides, so that the box can be used for two different purposes. For example, the box could be printed with flower designs for selling tulip and daffodil bulbs during the fall planting season, and then be reversed to a Christmas design for holding and displaying Christmas ornaments during the holiday season. An unlimited number of designs are possible with the box according to the invention.

To facilitate folding of the different panels and flaps, the box is preferably perforated along each fold line. The box could also be scored to facilitate the folding.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 1 is a perspective view of the assembled box according to the invention;

FIG. 2 is a top view of the unfolded box according to the invention;

DETAILED DESCRIPTION OF THE PREFERRED EMBODIMENT

Figure 3:
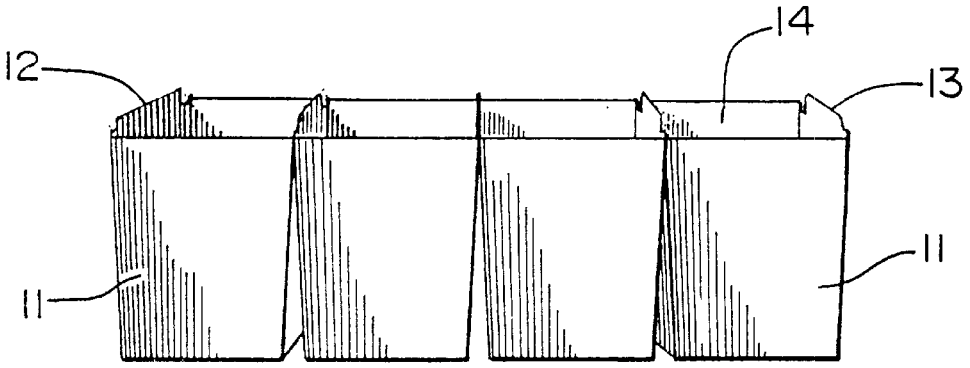
FIG. 3 is a front perspective view of several boxes according to the invention.

Referring now in detail to the drawings and, in particular, FIG. 1, there is shown a perspective view of the box 10 according to the invention, having a front panel 11, side panels 12 and 13 and a rear panel 14. Side panels 12 and 13 are equipped with ventilation holes 15 to ventilate the interior of box 10.

As shown in FIG. 2, box 10 is formed from a single sheet that is folded into place. Front panel 11, rear panel 14 and side panels 12 and 13 are all integrally formed with bottom panel 16 and are separated from bottom panel 16 by fold lines 24, 29, 26 and 27, respectively. Side panels 12 and 13 have front edges that are angled away from each other.

Side panel 12 has flap 18 integrally formed with the front edge of side panel 12 along fold line 23 and flap 17 integrally formed with the rear edge of side panel 12 along fold line 28. Fold lines 23 and 28 have slits 33 along a portion of their length.

Side panel 13 has flap 19 integrally formed with the front edge of side panel 13 along fold line 25. An extension flap 22 extends from the free end of flap 19 along fold line 31. Side panel 13 also has flap 20 integrally formed with the rear edge of side panel 13 along fold line 30. An extension flap 21 extends from the free edge of flap 20 along fold line 32.

Figure 5:
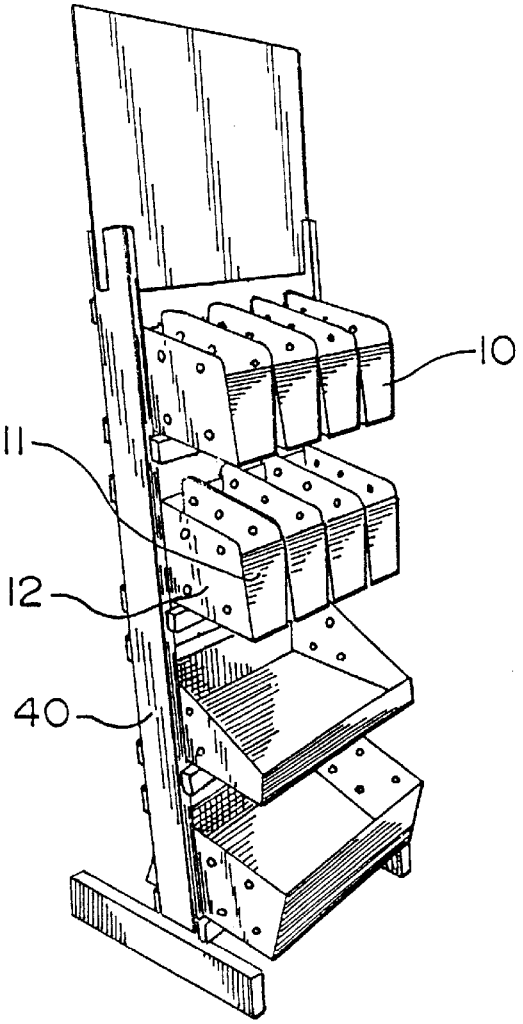
FIG. 5 is a side perspective view of the boxes according to the invention as they are mounted on a vertical display rack.

Side panels 12 and 13 each have a notch 38 formed in the top edge of the panels near flaps 17 and 20. Notches 38 allow box 10 to be fit into a vertical display rack 40 as shown in FIG. 5.

To assemble the box, side panels 12 and 13 are folded upward, front and rear panels 11 and 14 are also folded upward, flaps 17 and 18 are folded over end panels 11 and 14, respectively, and flaps 19 and 20 are folded over flaps 18 and 17, respectively. Extension flap 21 is then inserted into slot 33 along fold line 28, and extension flap 22 is inserted into slot 33 along fold line 23. Extension flaps 21 and 22 keep the panels and flaps in a folded, assembled position.

As can be seen from FIG. 3, box 10 as assembled state has a bottom that is narrower than the top. Thus, the surface area of the opening of box 10 is greater than the surface area of the bottom of box 10 so that the adjacent side walls 12 and 13 are not vertical. This ensures that when several boxes are mounted adjacent to one another, the contents of the box are still sufficiently ventilated through holes 15 on the sides of the box, and the space left open between adjacent sides.

Figure 4:
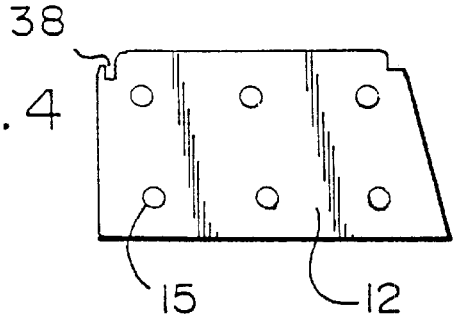
FIG. 4 is a side view of the box according to the invention.

As can be seen in FIG. 4, the sides of the box are trapezoidal in shape, with the front of the box being slanted rearward. This angle provides for a more aesthetic display and enables a better viewing angle when the boxes are hung on a vertical display rack, such as rack 40 shown in FIG. 5. Notches 38 on box 1 fit around a horizontal beam on rack 40, and the bottom of box 1 then rests on other horizontal bars. This construction facilitates the mounting of box 10 on vertical rack 40, as shown in FIG. 5.

One side of box 10 is usually printed with a display such as daffodils or tulips in bloom, growing in a garden. The inside of box 10 is usually left unprinted, but may be coated with a moisture-resistant material. When the box is folded as described with respect to FIG. 2, it can be folded also in reverse so that the printed decoration appears inside the box, and the outside is plain. This may be useful when the seasons change and other types of bulbs of merchandise are to be displayed in the boxes. Thus, the design of the box allows it to be folded in reverse to still come up with the same box shape.

Accordingly, while only one embodiment of the present invention has been shown and described, it is obvious that many changes and modifications may be made thereunto without departing from the spirit and scope of the invention.

What is claimed is:

1. A storage box having a bottom, two sides, a front, a back and a top and formed from a single folded sheet having two surfaces, comprising:

a bottom panel having two side edges, a front edge and a rear edge;

two side panels, each being integrally formed with a side edge of said bottom panel and having a free end, each side panel having a sloped front edge and a straight back edge such that said free ends are narrower than said side edges of said bottom panel;

a front panel integrally formed with said front edge of said bottom panel, said front panel having a free end that is wider than said front edge of said bottom panel;

a rear panel integrally formed with said rear edge of said bottom panel, said rear panel having a free end that is wider than said rear edge of said bottom panel;

a plurality of flaps, each having a free end and being integrally formed with the front and back edges of each of said side panels; and means for securing the box in an assembled state, such that the box can be assembled by folding said front panel, rear panel, and side panels perpendicular to said bottom panel, folding said flaps on one side panel over said front and rear panels, folding said flaps on the other side panel over said flaps on said one side panel, and securing the box in an assembled state, wherein the box is narrower at the bottom than at the top and wherein the front of the box is angled rearward from vertical.

2. The box according to claim 1, further comprising a plurality of ventilation holes arranged on each of said side panels.

3. The box according to claim 1, wherein the sheet is pre-printed on one surface.

4. The box according to claim 1, wherein all of the edges are perforated to facilitate folding.

5. The box according to claim 1, wherein the box is made of cardboard.

6. The box according to claim 1, wherein the side panels are higher than said front and rear panels when the box is assembled.

7. The box according to claim 1, wherein the means for securing the box in an assembled state comprises:

two slits located one each along the front and back edges of one side panel; and two insertion flaps being attached one each to the front and back edges of the other side panel, wherein the insertion flaps are inserted into the slits after the flaps on the side panels are folded to secure the box in an assembled state.

8. The box according to claim 1, further comprising a notch formed on the free end of each side panel near the back edge of said side panel, said notch facilitating mounting of the box on a display rack.

9. The box according to claim 1, wherein the sheet is pre-printed on both surfaces.

* * * * *